US006386076B1

(12) United States Patent
Swanstrom, Jr.

(10) Patent No.: US 6,386,076 B1
(45) Date of Patent: May 14, 2002

(54) PLIERS WITH SEPARATELY INSTALLED JAWS

(75) Inventor: John E. Swanstrom, Jr., Duluth, MN (US)

(73) Assignee: Swanstrom Tools USA Inc., Superior, WI (US)

( * ) Notice: Subject to any disclaimer, the term of this patent is extended or adjusted under 35 U.S.C. 154(b) by 0 days.

(21) Appl. No.: 09/574,483

(22) Filed: May 19, 2000

(51) Int. Cl.[7] ..... B25B 7/02

(52) U.S. Cl. ..... 81/423; 81/385; 81/393; 81/405; 29/527.1

(58) Field of Search ..... 29/529, 527.1; 81/385, 393, 405, 415, 423

(56) References Cited

U.S. PATENT DOCUMENTS 3,600,979 A * 8/1971 Rozmus
3,717,921 A * 2/1973 Ygfors
4,903,558 A * 2/1990 Le Duc

* cited by examiner

*Primary Examiner*—Joseph J. Hail, III
*Assistant Examiner*—Willie Berry, Jr.
(74) *Attorney, Agent, or Firm*—Faegre & Benson LLP

(57) ABSTRACT

A pliers having separate jaws secured to handles by interengagement of either a press-fitted boss and corresponding smooth bore or a threaded boss and threaded bore between the jaws and handles. In at least round nose and needle nose embodiments each jaw has a generally symmetric envelope about a central axis and the threaded member is located concentric to the central axis for ease and economy of manufacture. The long nose embodiment may also utilize the symmetric envelope with a portion of the generally conical jaw removed to form a flat, work engaging surface. Mating surfaces perpendicular to the central axis maintain alignment of the jaw to its respective handle. Round nose, long nose and needle nose pliers may be manufactured using the present invention.

13 Claims, 8 Drawing Sheets

PLIERS WITH SEPARATELY INSTALLED JAWS

FIELD OF THE INVENTION

This invention relates to the field of hand tools designed for gripping, such as pliers.

BACKGROUND OF THE INVENTION

In the past, gripping tools such as pliers typically had jaws formed integrally with the handles. As a consequence, the hardness and resistance to wear were a function of the bulk material from which the tool was made. Typically there diverging ideals for the material properties of the jaws and handles of such tools. Jaws often are desired to be hard and very wear resistant, while joints and handles are most often desired to have good tensile strength, wear and fracture resistance. Handles do not need to be particularly hard or wear resistant. If the jaws and the handles are made from the same bulk material, compromises in the desired material properties often must be made. Furthermore, special purpose pliers such as long nose, needle nose, and round nose pliers typically required substantial "roll grinding" (usually performed manually) to achieve the desired finished shape for the jaws. The present invention overcomes shortcomings of the prior art by providing separate jaws for pliers that can be easily manufactured by more automated methods, and further provides an opportunity to tailor the metallurgical properties of the jaws independently of those of the handles.

DETAILED DESCRIPTION OF THE INVENTION

Figure 1:
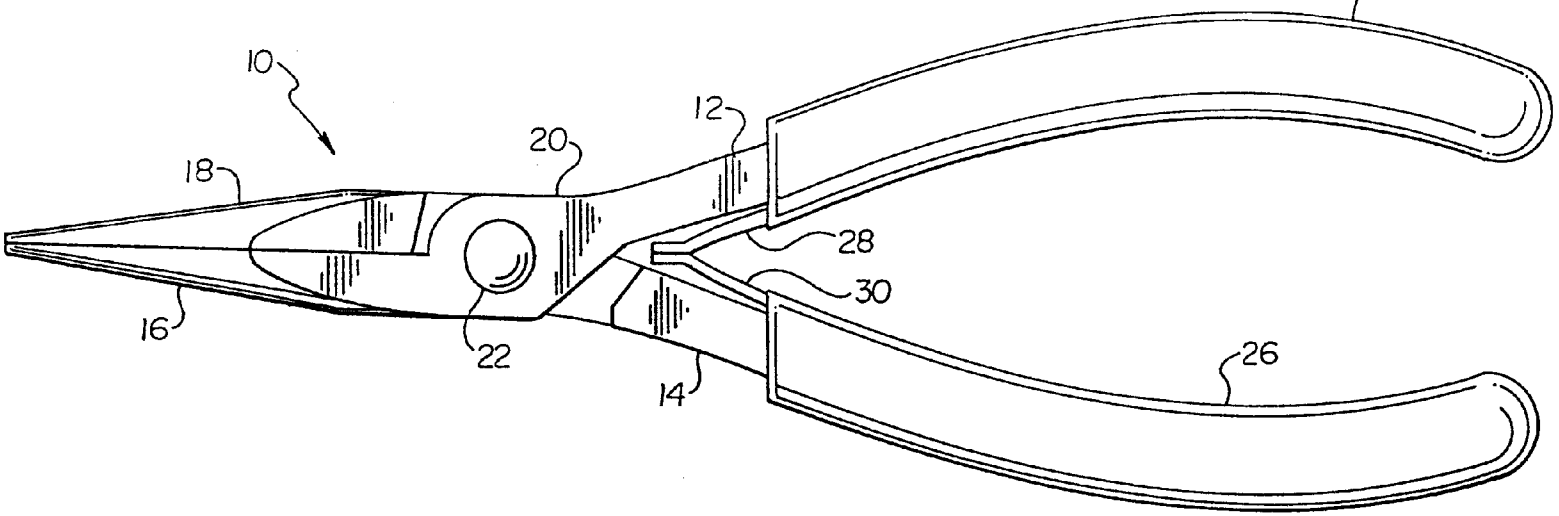
Fig. 1 PRIOR ART
FIG. 1 is a plan view of a prior art long nose pliers.
Figure 2:
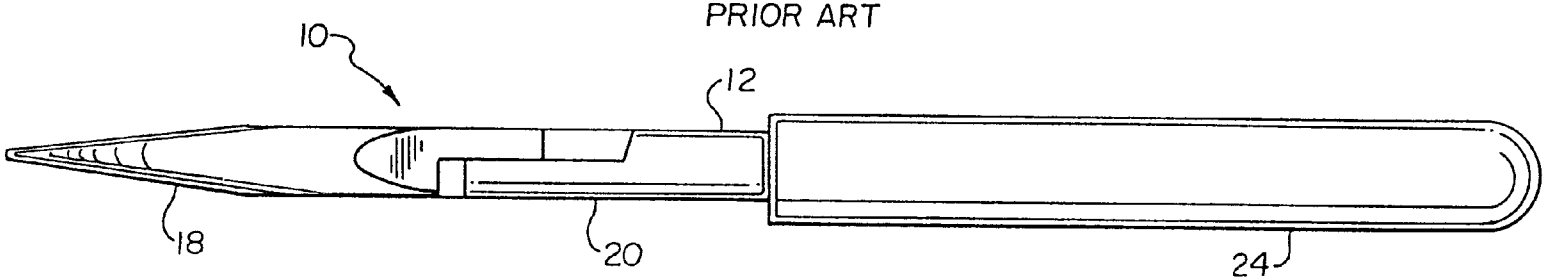
Fig. 2 PRIOR ART
FIG. 2 is a side view of the prior art pliers of FIG. 1.

Referring to the Figures, and most particularly to FIGS. 1 and 2, a prior art long nose pliers 10 may be seen. Pliers 10 have a pair of handles 12, 14 and integrally formed jaws 16, 18, with an intermediate portion 20 between, for example, the jaw 16 and its respective handle 12. Pliers 10 have a pivot mechanism 22 and may have handle covers 24, 26 and springs 28, 30 to urge the jaws 16, 18 open, as a, convenience to the user.

Figure 3:
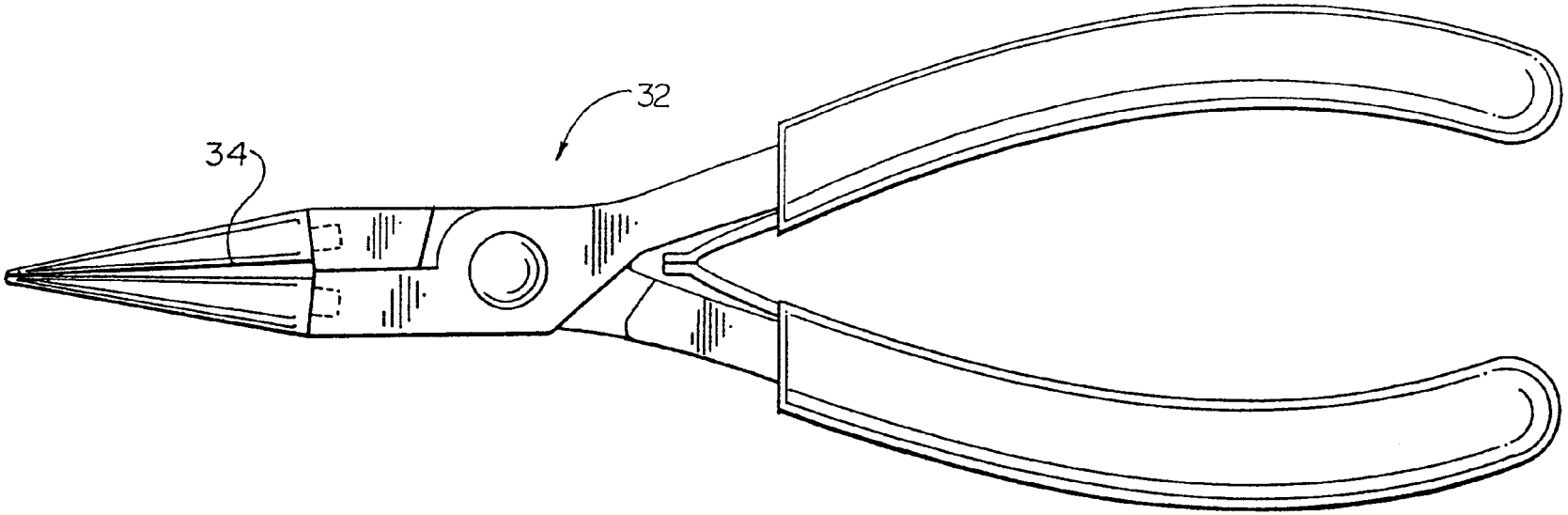
FIG. 3 is a plan view of a round nose pliers according to certain aspects of the present invention.
Figure 4:
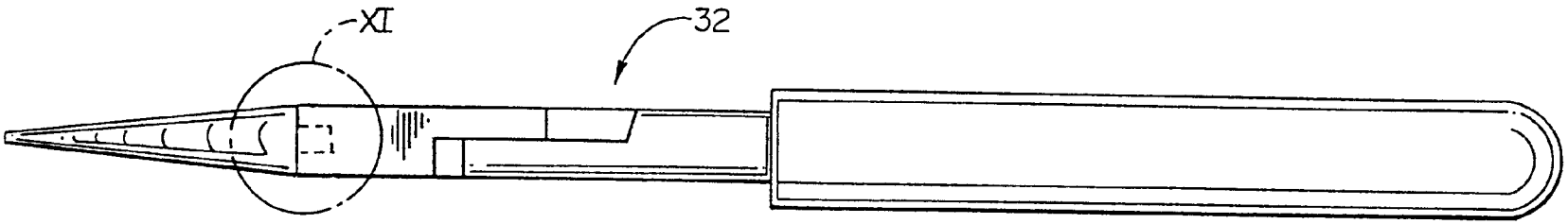
FIG. 4 is a side view of the pliers of FIG. 3.

Referring now to FIGS. 3 and 4, a first embodiment of pliers 32 according to the present invention may be seen. Pliers 32, as shown, are of the round nose type. In this type of pliers, the jaws are completely conical, without any opposed flats on the jaws. Such pliers are sometimes referred to as "jeweler's pliers." In addition, the jaws may have a space 34 therebetween, to better accommodate wire that is typically grasped and formed into a loop by such pliers.

Figure 5:
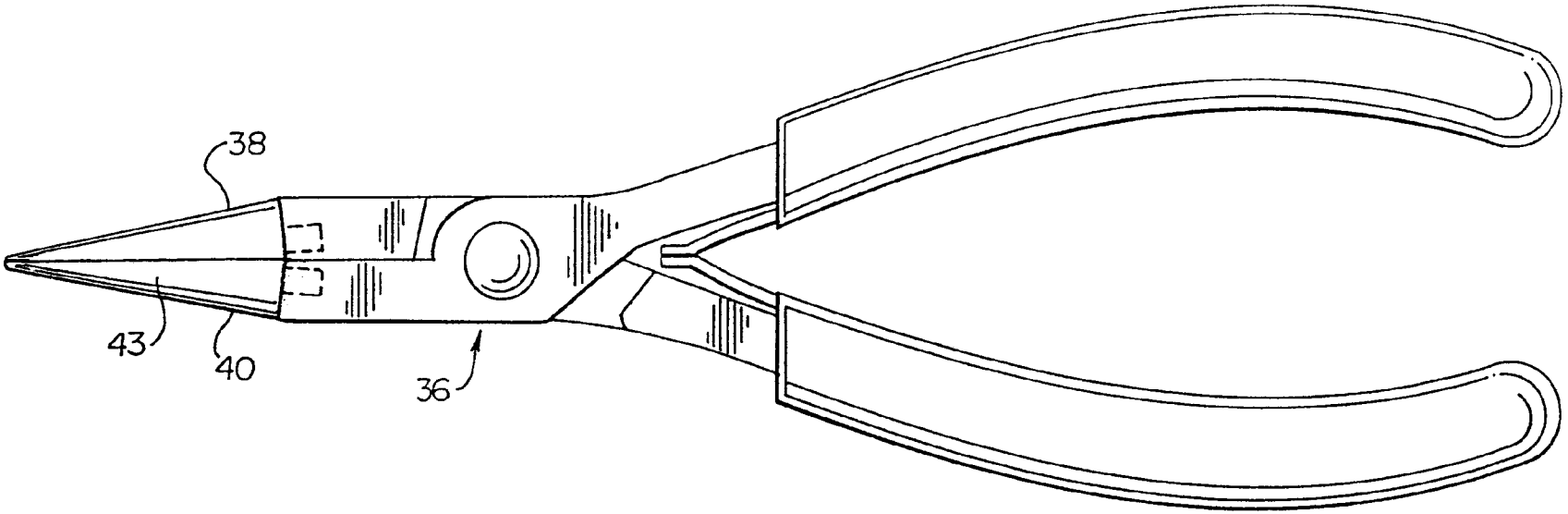
FIG. 5 is a plan of a needle nose pliers according to the present invention.
Figure 6:
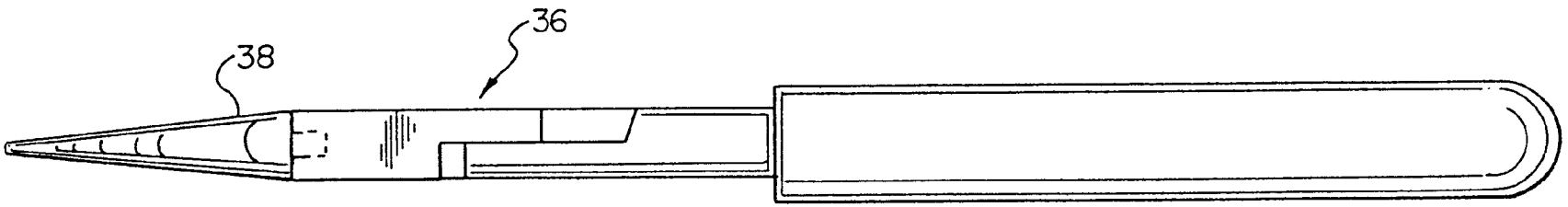
FIG. 6 is a side view of the pliers of FIG. 5.
Figure 7:
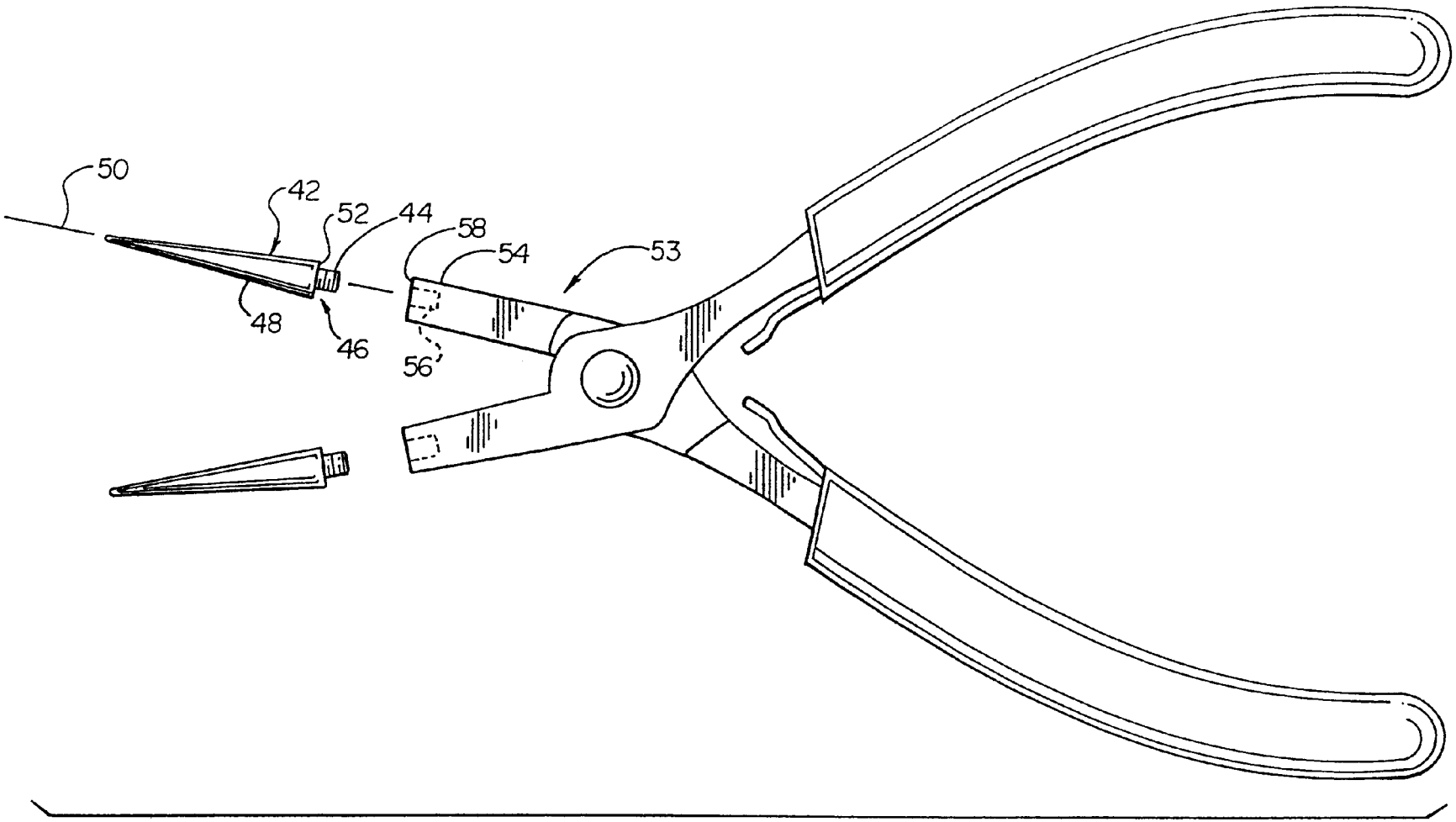
FIG. 7 is an exploded view of one embodiment of pliers according to the present invention showing certain mounting details of the jaws.
Figure 8:
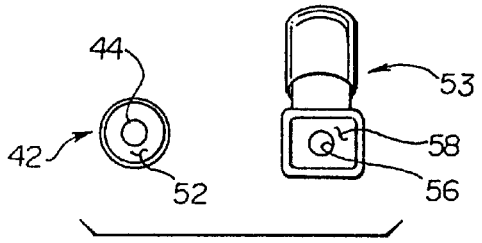
FIG. 8 is an end-on view of a jaw and a jaw mount support of a handle useful in the practice of the present invention.
Figure 9:
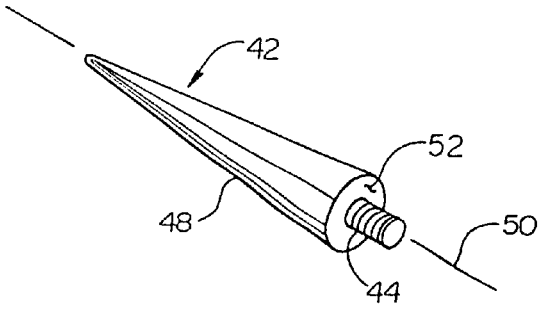
FIG. 9 is a perspective view of a round nose jaw useful in the practice of the present invention.

Referring now to FIGS. 5 and 6, a pair of needle nose pliers 36 according to the present invention may be seen. The jaws 38, 40 of pliers are to be understood to be D shaped in cross section with a flat 43 on each jaw meeting at a closing plane. It is to be understood that the closing plane is perpendicular to a pivot plane in which the jaws of the pliers rotate to open and close. The closing plane is parallel to the flat 43 when the jaws are closed and the pivot plane is parallel to a plane of the paper showing FIG. 5. The pivot plane is to be understood as being parallel to the flat sides of the pliers 36. The D shaped profile and the flat 43 of the jaw 40 may be seen most clearly in the perspective view of FIG. 10.

When pliers close, it is usually desirable that the tips of the jaws meet first with the jaws having a controlled, but small amount of clearance near the joint. This assures tip grip strength on small objects before the remainder of the jaws "bottom out" or contact each other, thereby limiting tip force.

Referring now to FIGS. 7, 8, 9 and 11, jaw 42 (shown here as a conical round nose style) preferably has a threaded boss 44 extending from the proximal end 46 thereof. Jaw 42 has a generally conical outer surface or envelope 48, with both the boss 44 and envelope concentric to a central axis 50. Jaw 42 also preferably has a flat face 52 generally perpendicular to the central axis 50. A handle 53 preferably has a jaw support mount 54 with a threaded bore 56 and a face 58 generally perpendicular to the bore 56.

Figure 10:
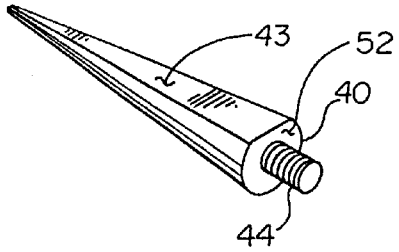
FIG. 10 is a perspective view of a needle nose jaw useful in the practice of the present invention.
Figure 11:
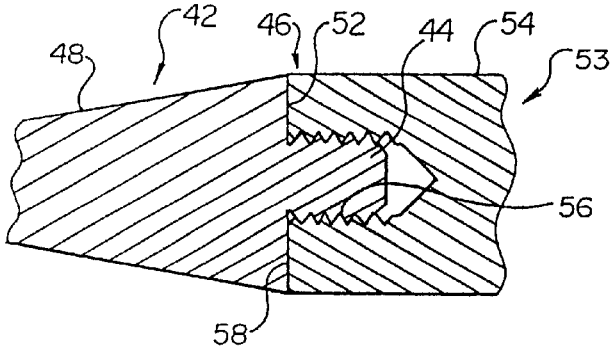
FIG. 11 is an enlarged fragmentary section view of region XI of FIG. 4 showing a tapped insert as an alternative.
Figure 12:
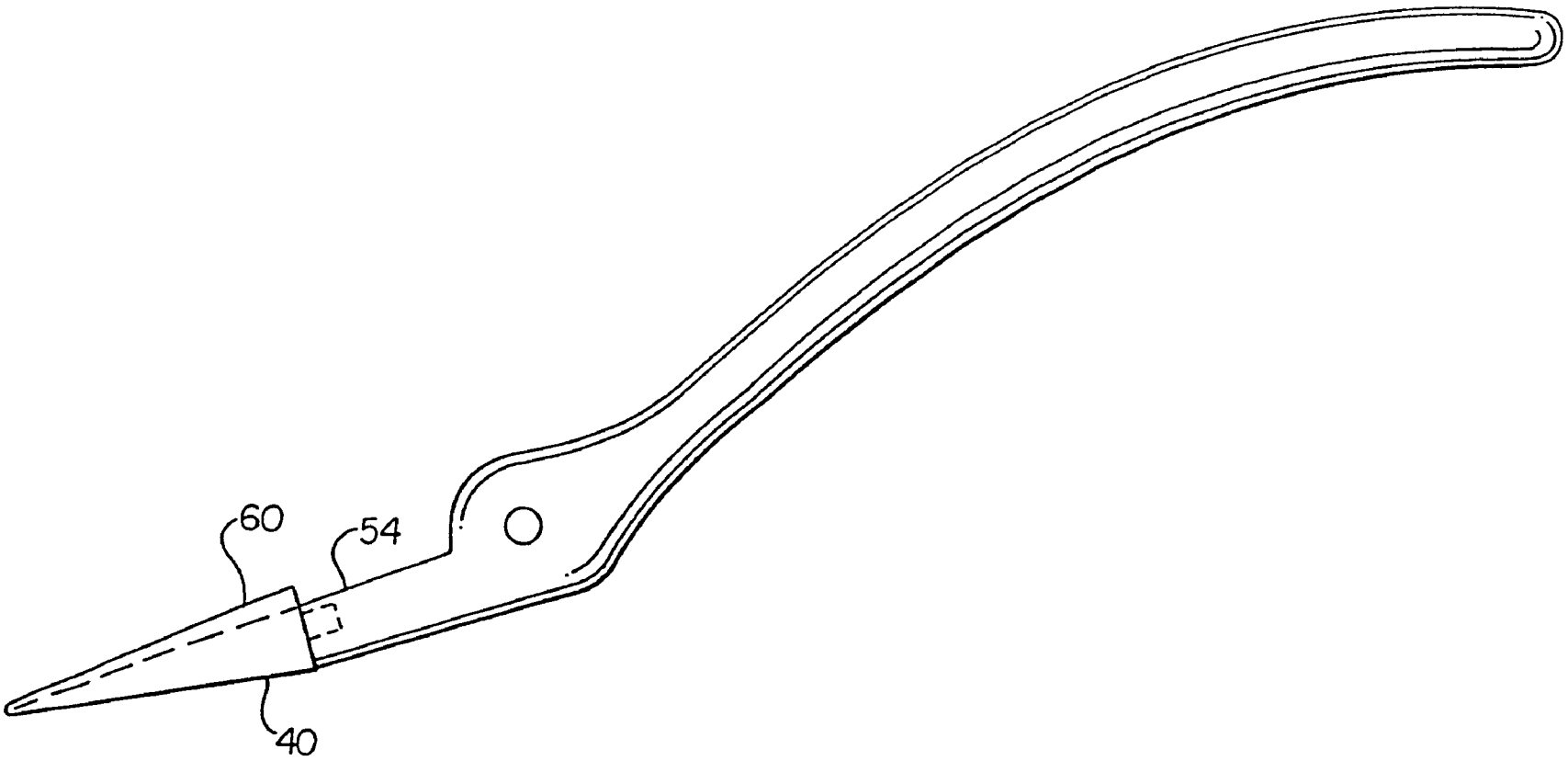
FIG. 12 is a plan view of a handle and jaw assembly shown prior to finished condition to illustrate certain aspects of the present invention.

Referring now again to FIGS. 5 and 6, and also to FIGS. 10 and 12, the needle nose alternative embodiment 36 is preferably formed to have jaws 38, 40 with a D shaped cross section having flat 43 as may be most clearly seen in FIG. 10. To assure that the flat 43 will be aligned with the closing plane of the pliers 36, it has been found preferable to initially form jaw 40 as a fully conical surface as illustrated in FIG. 12, and then to install jaw 40 to the jaw support mount 54 such that jaw 40 has an overhanging region 60 extending laterally of the jaw support mount 54. Once jaw 40 is installed and secured to the handle, region 60 is removed by, for example, grinding, while holding the handle and jaw assembly (without rotating) to maintain alignment of the flat 43 with the closing plane. This is far less fatiguing to manufacturing personnel than is the common technique of roll grinding the forgings down to a desired tip size.

Figure 13:
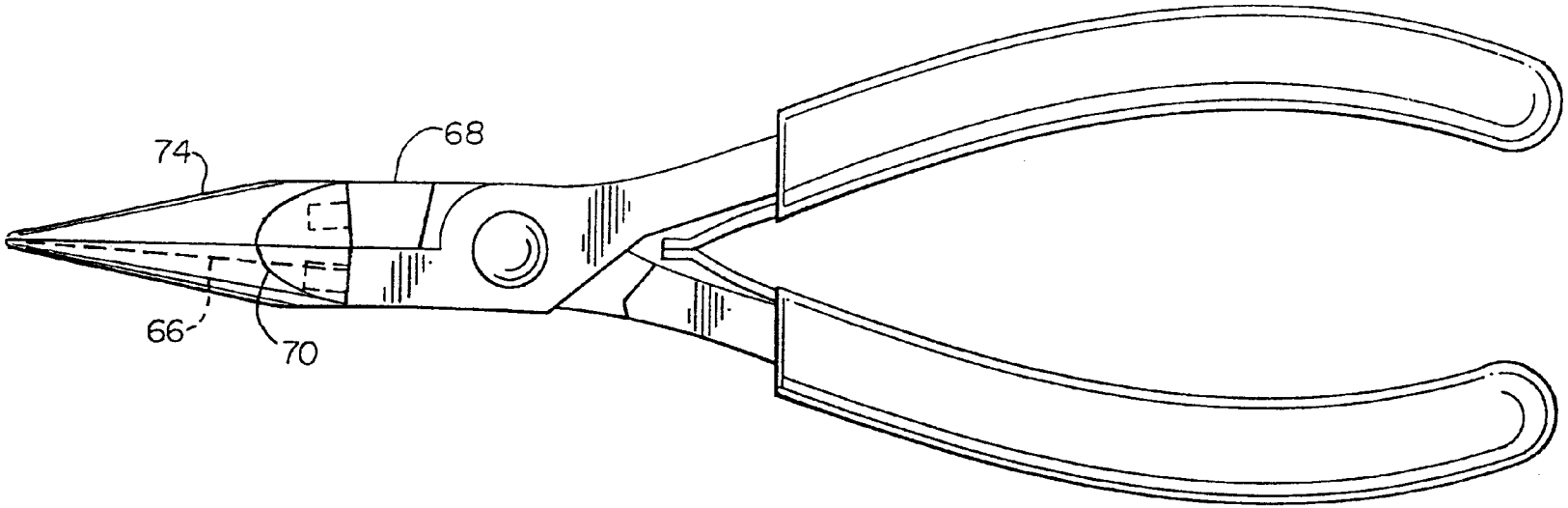
FIG. 13 is a plan view of a pair of long nose pliers according to certain aspects of the present invention.
Figure 14:
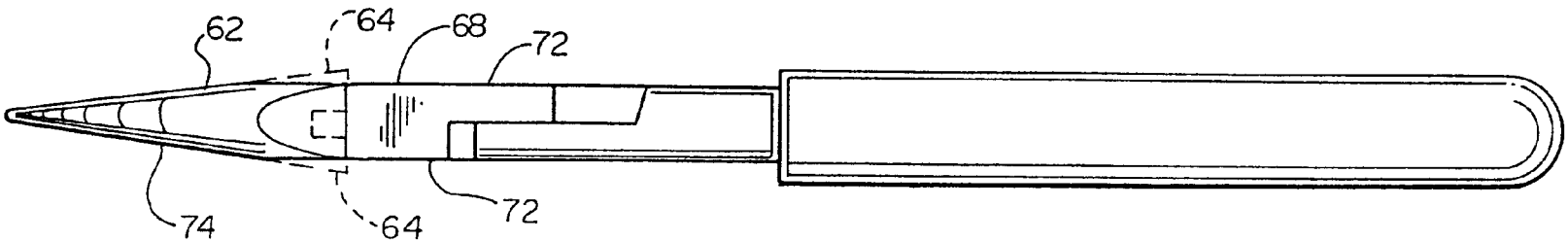
FIG. 14 is a side view of the pliers of FIG. 13.
Figure 15:
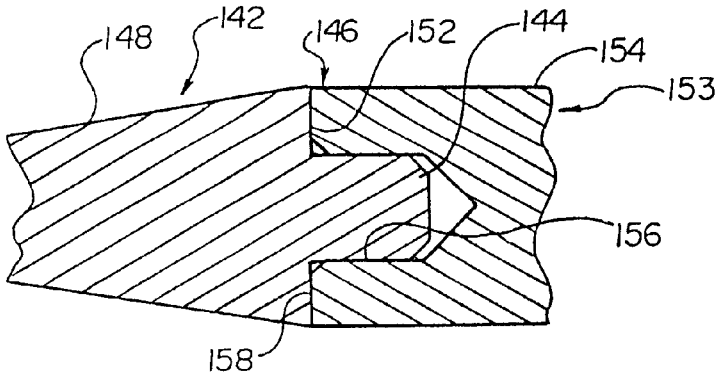
FIG. 15 is an enlarged section view similar to that of FIG. 11, except with a press-fit embodiment of the present invention.
Figure 16:
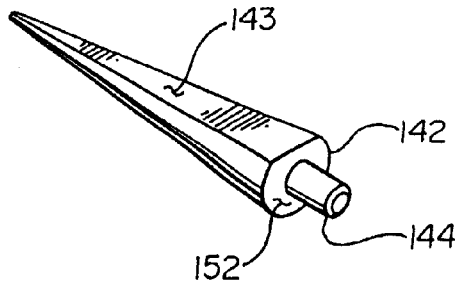
FIG. 16 is a view similar to that of FIG. 10, except with a smooth surfaced plug for the press-fit embodiment of FIG. 15.
Figure 17:
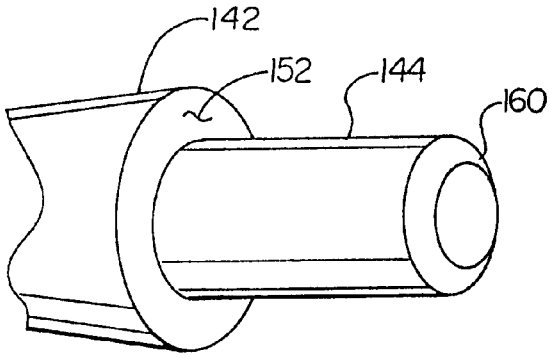
FIG. 17 is an enlarged fragmentary perspective view of the plug of FIG. 16.
Figure 18:
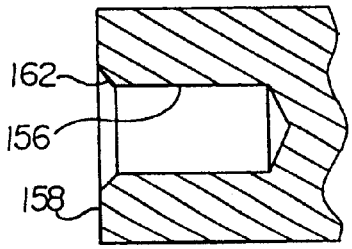
FIG. 18 is a fragmentary section view of the smooth-walled bore in the handle portion for the press-fit embodiment of FIG. 15.

Referring now also to FIGS. 13 and 14, a configuration closely imitating a traditional long nose shape may be achieved by installing a conical jaw 62 having lateral overhang regions 64 in addition to a closing plane overhang region 66 similar to region 60 in the needle nose configuration of FIG. 12. Once jaw 62 is installed in its respective jaw support mount 68, region 66 is removed in a manner similar or identical to the removal of region 60, and lateral overhanging regions 64 are removed by, for example, grinding, resulting in the traditional parabolic line of intersection 70 of the flat sides 72 of the handles with the generally conical surface or envelope of the long nose jaw 62. It is also to be noted that in FIGS. 13 and 14, the threaded boss is on the jaw support mount 68 and the threaded bore is in the jaw 62.

Referring now to FIGS. 15–18, it is to be understood that it is within the scope of the present invention to secure the jaws to the handles by means other than interengaging threads, for example, by using a press fit between the mounting boss and the mating bore.

In the embodiment shown in FIGS. 15–18, jaw 142 (shown here as a conical round nose style) preferably has a smooth surfaced boss 144 extending from the proximal end 146 thereof. Jaw 142 has a generally conical outer surface or envelope 148, with both the boss 144 and envelope 148 concentric to a central axis 150. Jaw 142 also preferably has a flat face 152 generally perpendicular to the central axis 150. A handle 153 preferably has a jaw support mount 154 with a corresponding smooth walled or surfaced bore 156 and a face 158 generally perpendicular to the bore 156. It is to be understood that mounting boss 144 and mating bore 156 are preferably sized to have an interference fit, and are preferably press-fitted together, resulting in the assembly shown in FIG. 15. For a pliers with 1 inch long jaws, an interference length for the plug and bore is preferably at least about 0.150 inches with a diameter of at least about 0.125 inches. The interference fit between the plug and bore is preferably about 0.001 inches, and may be adjusted as is well known according to standard references such as Mark's Standard Handbook for Mechanical Engineers or Machinery's Handbook. It is to be further understood that the bore may be located on the jaw and the boss on the handle, and each may have other than a cylindrical configuration, provided that they assemble together in a press-fit relationship. Boss 144 may have a chamfer 160, and bore 156 may similarly have a chamfer or initial taper 162 to assist in initially aligning the boss with the bore upon the commencement of press-fit assembly. The chamfers are preferably, but not necessarily 45°. It is to be further understood that locking means such as, an adhesive or braze may be used to secure the jaw to the handle. When an adhesive is used, it may serve as a lubricant to aid installation before it "sets" or cures. One form of brazing material that may be used is SRA #STK-1260-650 (liquidus 1305° F., solidus 1220° F.). Other types of braze materials may also be used. Materials for the jaws include, but are not limited to stainless steel, titanium and bronze, while materials for the handles include, but are not limited to steels such as AISI 52100, 5160, or C1070.

It can thus be seen that the present invention is directed to a pliers assembly having a pair of handles, with each handle having a mediate region for mounting a pivot member, a grasping portion located on one side of the mediate region, and a jaw support mount located on the other side of the mediate region. The pliers assembly also has a pivot member for pivotably securing the mediate regions of the handles together and a pair of jaws each mounted to a respective jaw support mount with each jaw having a central axis and a generally symmetric envelope or outer surface enabling the manufacture of the jaws to be accomplished on a lathe. The pliers assembly also includes a threaded or smooth surfaced mounting boss on one of the jaw and jaw support mount, and a corresponding threaded or smooth bore on the other of the jaw and the jaw support mount, with the boss received in the bore to mount the jaw to the handle by engagement of the threads or a press-fit between the smooth boss and bore.

In one form of construction of the pliers of the present invention, it is preferable to carry out the process of forging a pair of handles and machining either a threaded boss or threaded bore in ajaw support mount in each handle, machining each of a pair of jaws to have a generally circularly cylindrically symmetric envelope about a central axis, and machining the other of the threaded boss and threaded bore at a proximal end of each jaw. The jaws are then preferably attached to the handles by engaging the boss with the bore; and the pliers assembly is formed by pivotably attaching the mediate portions of the handles together. In one aspect of the present invention, a conically shaped jaw is attached to the jaw support mount of the handle with an overhanging portion which is then removed (by, e.g., grinding) to form a flat on one surface of the jaw, when it is desired to have flat opposed surfaces on the jaws coming together at a closing plane when the pliers are closed.

The present invention eliminates the need for long nose forge and trim die sets and the related separate inventories. The present invention enables long nose tools to be made from the same (shorter) forgings that are used for cutters. The tips can be manufactured from relatively small diameter stock using a lathe in contrast to having to forge bar stock, resulting in savings in both material and labor.

The jaws may be locked to the handles by an adhesive such as an anaerobic adhesive, or by a mechanical fastener such as a set screw transverse to the boss, or by a metallurgical bond such as a tack weld, braze between the jaw and handle, shrink fit by heating the part having the bore and or cooling the part having the plug, or by using interference-fit threads. It is further contemplated (in an alternative embodiment) to be within the scope of the present invention to secure the jaws to the handles by an interference fit between mating surfaces such as an unthreaded boss and an unthreaded bore, followed by locking the jaw to the handle, for example, by a braze connection at the interface between the jaw and handle.

It is contemplated that tools destined for use in high technology applications may only need a threaded insert between the jaw and jaw support mount with a glue to retain the jaw to the handle, because of the light duty such tools are exposed to.

It is to be further understood that as an alternative to making the jaws harder than the handles, such as when, for example the jaws are tungsten or stainless steel and the handles are formed of a softer steel, it is possible to make the jaw from a material that has a lower hardness than the handles. Such a combination would be present with a pliers having handles formed of steel and jaws formed of bronze, for example.

This invention is not to be taken as limited to all of the details thereof as modifications and variations thereof may be made without departing from the spirit or scope of the invention.

What is claimed is:

1. A method of manufacturing pliers comprising the steps of:

a. forging a pair of handles each handle having a mediate region for mounting a pivot member, a grasping portion located on one side of the mediate region and a jaw support mount on the other side of the mediate region;

b. machining one of a mounting boss and a mating bore in each of the jaw support mounts;

c. machining each of a pair of jaws to have a generally circularly cylindrically symmetric envelope about a central axis, and machining the other of the mounting boss and mating bore at a proximal end of each jaw;

d. attaching each jaw to a respective one of the pair of handles by engaging the boss with the bore; and e. pivotably attaching the mediate portions of the handles together.

2. The method of claim 1 further including: forming threads on the one of the mounting boss and mating bore in step b, forming matching threads on the other of the mounting boss and mating bore in step c, and engaging the threads of the mounting boss with the threads of the mating bore to mount the each jaw to a respective handle in step d.

3. The method of claim 1 further including forming the mounting boss with a smooth exterior surface, and forming the mating bore with a matching smooth interior surface and further wherein the mounting boss and the mating bore are press fitted together to mount each jaw to a respective handle.

4. The method of claim 3 wherein the press-fitting between each mounting boss and mating bore is an interference fit.

5. The method of claim 1 further comprising an additional step d1 after step d d1. removing a portion of each jaw to form a flat on one surface thereof such that the flats are opposed to each other when the handles are pivotably attached to each other.

6. The method of claim 5 wherein step d1 is performed before step e.

7. The method of claim 5 wherein the flat is formed by grinding.

8. The method of claim 1 further comprising an additional step d1 after step d of:

d1. using locking means to lock each jaw to its respective handle.

9. The method of claim 8 wherein the locking means is selected from chemical, mechanical and metallurgical fastenings.

10. The method of claim 9 wherein the chemical fastenings include adhesives.

11. The method of claim 9 wherein the mechanical fastenings include a set screw.

12. The method of claim 9 wherein the metallurgical fastenings include brazing.

13. A jaw and handle combination for a pliers formed by the method comprising the steps of:

a. forming a handle having a jaw support mount;

b. forming a jaw separate from the handle with the jaw having a generally conical exterior surface having a base and a central axis;

c. attaching the jaw to the handle such that a portion of the jaw overhangs the jaw support mount of the handle in the region of the base; and forming a flat on the jaw aligned with a closing plane of the jaw and handle.

* * * * *